US007946633B2

(12) United States Patent
Minter

(10) Patent No.: US 7,946,633 B2
(45) Date of Patent: May 24, 2011

(54) LOW FRICTION ADJUSTABLE ROLLER PIN

(75) Inventor: Peter Minter, Reno, NV (US)

(73) Assignee: Interlock USA, Inc., Reno, NV (US)

( * ) Notice: Subject to any disclaimer, the term of this patent is extended or adjusted under 35 U.S.C. 154(b) by 108 days.

(21) Appl. No.: 11/852,441

(22) Filed: Sep. 10, 2007

(65) Prior Publication Data

US 2009/0066094 A1 Mar. 12, 2009

(51) Int. Cl.
*E05C 9/00* (2006.01)
*E05C 1/04* (2006.01)

(52) U.S. Cl. ..... 292/23; 292/9; 292/150; 49/394

(58) Field of Classification Search ..... 292/9, 12, 292/15, 23, 137, 143, 146, 149, 150, 155, 292/302, 304, 340, 341.11, DIG. 51; 49/394
See application file for complete search history.

(56) References Cited

U.S. PATENT DOCUMENTS 4,621,847 A * 11/1986 Paulson et al. ..... 292/199
4,803,808 A 2/1989 Greisenr
5,072,489 A * 12/1991 Aumercier ..... 16/361
5,318,333 A 6/1994 Dreifert
5,370,428 A * 12/1994 Dreifert et al. ..... 292/161
5,553,420 A * 9/1996 Klimek ..... 49/501
5,782,114 A * 7/1998 Zeus et al. ..... 70/109
5,964,011 A * 10/1999 Ruston et al. ..... 16/239
6,450,554 B1 9/2002 Rotondi et al.
6,651,389 B2 11/2003 Minter et al.
2003/0079414 A1* 5/2003 Rangabasyam et al. ..... 49/395

OTHER PUBLICATIONS

"WW Kurier-GLS", One-Hand-Operation Fittings, Edition Jan. 1989.
"ROTO WW 41", Espagnolettes for Outward Opening Windows, Edition Jan. 1990.

* cited by examiner

*Primary Examiner* — Carlos Lugo
*Assistant Examiner* — Alyson M Merlino
(74) *Attorney, Agent, or Firm* — DeLio & Peterson, LLC

(57) ABSTRACT

A roller pin of the type mounted on a tie bar that slides to drive the roller pin into engagement with a keeper of a casement window includes an inner pin and an outer roller. The outer roller includes an integral outer flange that is circular and spins with the outer roller to reduce friction during engagement with keeper. The inner pin includes an offset mounting pin at one end and is enlarged at the other end to hold the outer roller on the inner pin. The enlarged end of the inner pin is flush with the outer flange and is provided with a recessed opening that receives a tool, such as a screwdriver, to rotate the inner pin and adjust its position relative to the tie bar and a keeper. The invention is also directed to a tie bar and multiple roller pins in combination.

17 Claims, 3 Drawing Sheets

LOW FRICTION ADJUSTABLE ROLLER PIN

BACKGROUND OF THE INVENTION

1. Field of the Invention

The present invention relates to devices for locking a casement window. More specifically, the present invention relates to roller pins mounted on a tie bar where the roller pins engage corresponding keepers to lock the casement window at multiple points. Still more specifically, the present invention relates to an improved roller pin design that reduces friction between a roller pin and a corresponding keeper as the casement window locking mechanism is operated.

2. Description of Related Art

Casement windows are typically hinged along one side and swing closed into a fixed frame. One type of locking mechanism for casement windows uses a flat tie bar slidably mounted to the window frame along the open side of the window. The tie bar is provided with multiple locking pins that extend outward from the tie bar. A locking handle is provided on the interior of the window frame that can be thrown by the user between locked and unlocked positions. The locking handle slides the tie bar, which moves each locking pin between a corresponding locked and unlocked position.

The casement window sash is provided with multiple hook-shaped ramped keepers that move into position in front of the locking pins on the frame as the window is closed. The user then moves the locking handle to the locked position, which slides the tie bar and drives each individual locking pin into engagement with the hooked portion of a corresponding keeper.

One problem with older locking pin designs is friction and excess wear between the locking pin and the keeper. Friction can be particularly objectionable when multiple locking pins are simultaneously being engaged by their respective keepers as the locking handle is moved. A partial solution to this problem has been developed through the use of an outer cylindrical roller that rotates on an inner pin. The inner pin serves as an axle for the outer roller. The outer roller provides a low friction rolling contact between the inner hook portion of the keeper and the outer surface of the locking pin. A locking pin of this type is referred to herein as a "roller pin."

In a conventional roller pin design, the inner pin is adjustably attached at one end to the tie bar and is provided with an end plate at the opposite end that is larger in diameter than the maximum diameter of the outer roller. The end plate is parallel to the tie bar. The outer roller, which is cylindrical, is loosely held between the end plate of the inner pin and the tie bar where it is free to rotate about the inner pin.

In this type of roller pin design, the end plate has a diameter that is greater than the inner width of the opening in the hook portion of the keeper. The keeper engages the outer roller of the pin and is held between the tie bar and the end plate. This increases security by preventing the keeper from being pulled over the end of the roller pin. A roller pin of this type is disclosed in U.S. Pat. No. 6,651,389 issued to Minter, et al. on Nov. 25, 2003.

However, because the end plate in this type of roller pin design is part of the fixed inner pin, it does not rotate with the outer roller. As the tie bar slides and the roller pins move into their respective keepers, the fixed end plates slide directly against a surface of the keeper producing friction and wear. When multiple roller pins and keepers are simultaneously being engaged, this friction becomes objectionable.

In prior art roller pin designs of the type described above the end plate on each roller pin is non-circular. It may, for example, be shaped as a square. This allows the installer to grip the end plate with a wrench or pliers and rotate the inner pin. The inner pin is eccentrically mounted to the tie bar and this rotation adjusts the location of the roller pin relative to the tie bar and the keeper.

Although this adjustment is effective, the non-circular shape of the end plate has several disadvantages. One disadvantage arises when the roller pins are visible. Each individually adjusted roller pin will have a different angular orientation. The non-circular end plates on different roller pins will not align with each other, or with the tie bar, producing a haphazard and unattractive appearance.

Another disadvantage to the non-circular shape of the end plate is that portions of the end plate extend farther out from the axis of the roller than other portions. This increases the contact area between the end plate and the keeper beyond the minimum necessary, thereby producing a further increase in undesirable friction.

Still another disadvantage is that the non-circular shape requires greater clearance between the end plate and other portions of the window to accommodate all possible orientations of the end plate.

SUMMARY OF THE INVENTION

Bearing in mind the problems and deficiencies of the prior art, it is therefore an object of the present invention to provide a roller pin design that reduces friction between the roller pin and the keeper.

It is another object of the present invention to provide a roller pin design that is adjustable and provides an improved appearance at all adjustment orientations.

It is a further object of the present invention to provide a roller pin design that is adjustable and requires less clearance from other components.

Still other objects and advantages of the invention will in part be obvious and will in part be apparent from the specification.

The above and other objects, which will be apparent to those skilled in the art, are achieved in the present invention which is directed to a roller pin for engagement by a keeper of a casement window wherein the roller pin includes an inner pin and an outer roller. The inner pin includes a middle portion, a first end and a second end.

The middle portion of the inner pin is substantially cylindrical and defines a first axis. The first end of the inner pin includes a mounting pin pivotally connected to a tie bar. The mounting pin defines a second axis offset from the first axis. The second end of the inner pin is enlarged and shaped to engage a tool for rotating the inner pin around the second axis relative to the tie bar to reposition the middle portion of the inner pin relative to the tie bar.

The outer roller is substantially cylindrical and is mounted on the inner pin for rotation about the first axis. The outer roller has an outer bearing surface and an outwardly extending perimetrical flange at one end. The outer roller is rotatably held between the enlarged second end of the inner pin and the tie bar. The perimetrical flange acts to retain the keeper between the tie bar and the perimetrical flange. The perimetrical flange rotates with the outer roller to reduce friction between the roller pin and the keeper during engagement between the roller pin and the keeper.

In one aspect of the invention, the enlarged second end of the inner pin is provided with a recessed opening to receive the tool for rotating the inner pin around the second axis.

The enlarged second end of the inner pin is preferably provided with a recessed crosshead opening to receive a crosshead-type screwdriver.

In another aspect of the invention, the second end of the inner pin includes a conical outer surface acting to retain the outer roller.

The perimetrical flange preferably includes an upper surface that is substantially level with an upper surface of the second end of the inner pin.

In still another aspect of the invention, the mounting pin extends through the tie bar and is enlarged on an opposite side of the tie bar to rotatably retain the roller pin on the tie bar.

The outwardly extending perimetrical flange and the outer bearing surface preferably form a right angle and are integrally formed as a single piece with the outer roller.

The invention is also directed to a plurality of roller pins as described above in combination with a tie bar wherein the tie bar includes a plurality of spaced mounting holes having the mounting pin of each roller pin mounted therein.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-4 of the drawings in which like numerals refer to like features of the invention.

Figure 1:
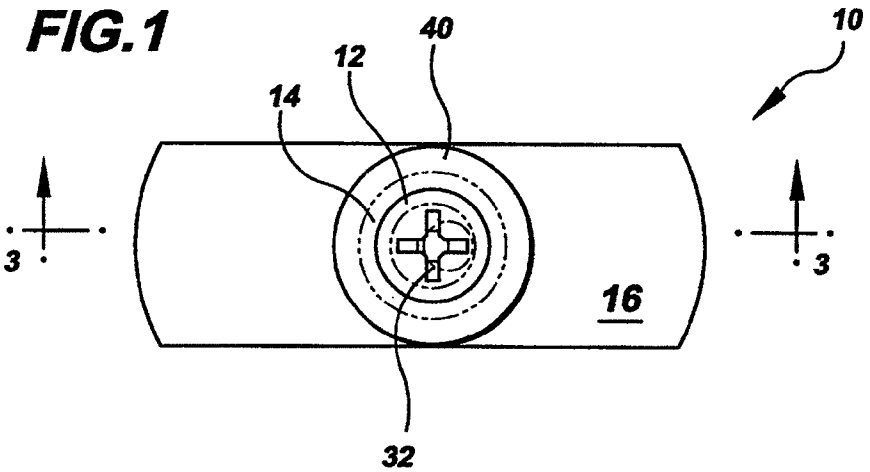
FIG. 1 is a top plan view of a roller pin according to the present invention showing the roller pin mounted on a portion of a tie bar.
Figure 2:
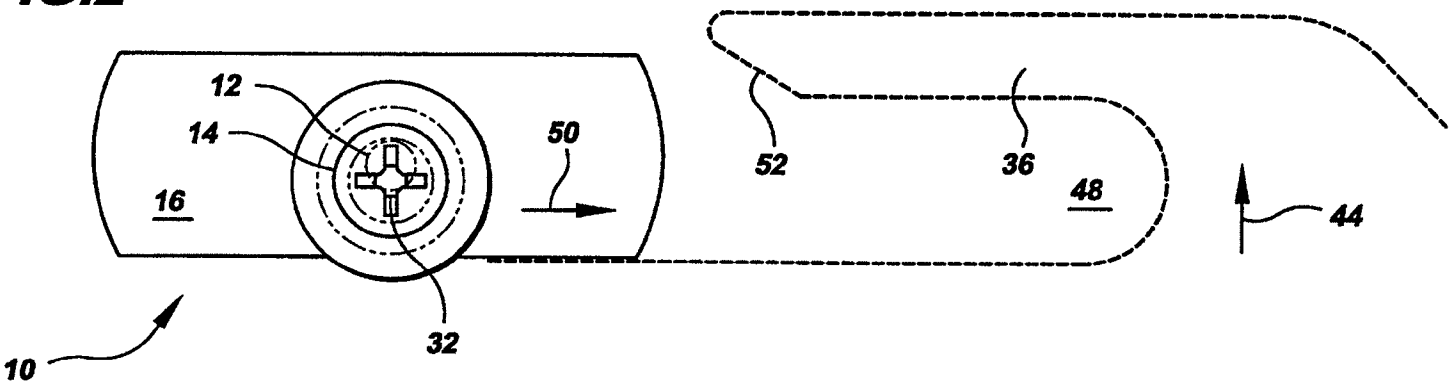
FIG. 2 is a top plan view of the roller pin in FIG. 1 except that the roller pin has been adjusted by rotating the roller pin ninety degrees relative to the tie bar to align the pin with a keeper (shown in phantom).
Figure 3:
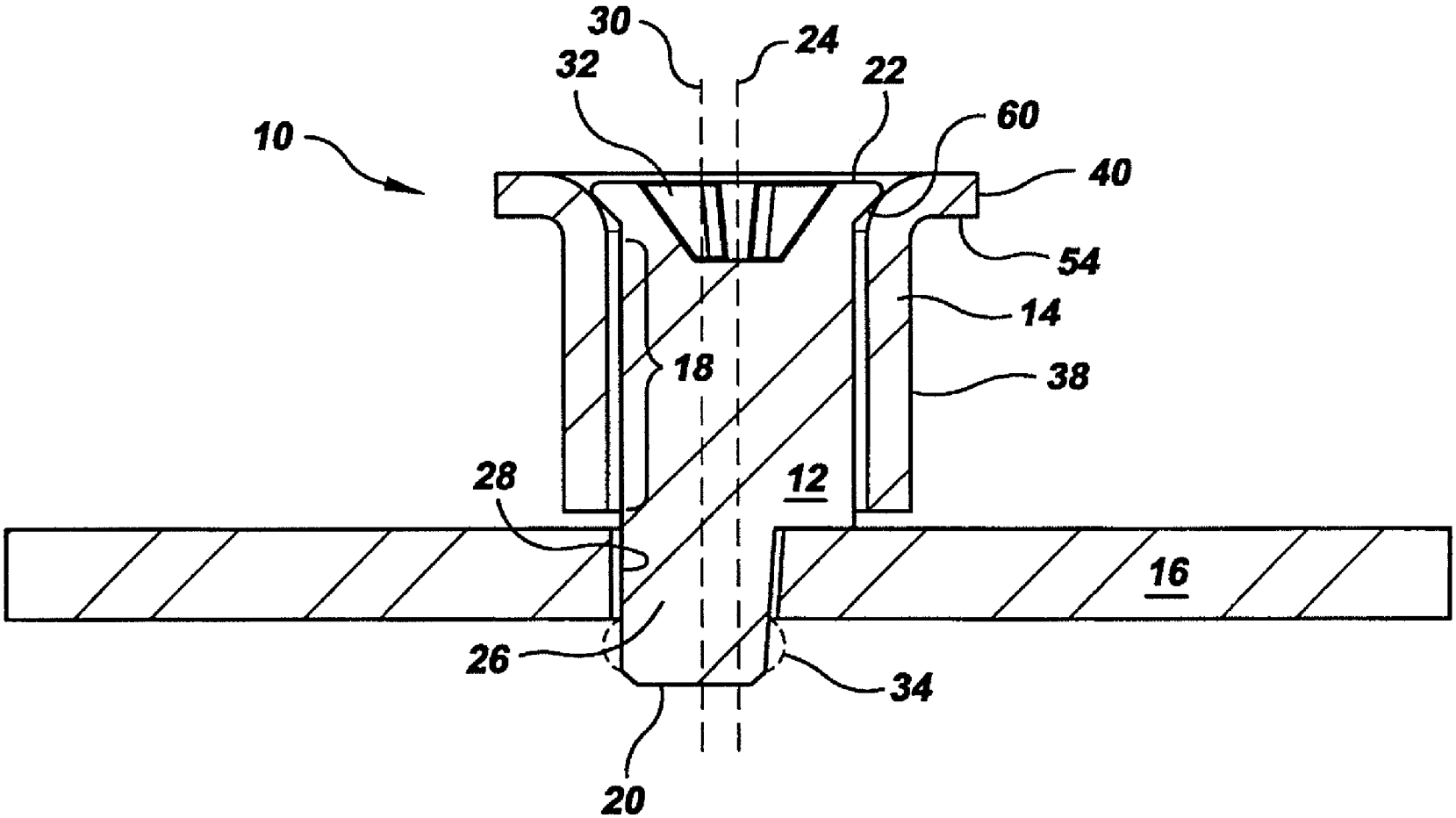
FIG. 3 is a cross sectional view of the roller pin and tie bar in FIG. 1. The cross section is taken along the line 3-3 in FIG. 1.

Referring to FIGS. 1-3, the present invention is directed to a roller pin 10 having an inner pin 12 that forms an axle for an outer roller 14. The inner pin is mounted to a tie bar 16 that slides in the direction indicated by arrow 50 in FIG. 2.

The inner pin 12 includes a middle portion 18, a first end 20, and a second end 22. The middle portion 18 is substantially cylindrical and defines a first axis 24. The outer roller 14 rotates about the first axis 24 on the cylindrical middle portion 18 of the inner pin.

The first end 20 of the inner pin 12 includes a mounting pin 26 that extends through opening 28 in the tie bar 16. The mounting pin 26 defines a second axis 30 that is offset from the first axis 24. When a torque is applied to the inner pin 12, the inner pin rotates about the mounting pin 26 and the second axis 30. This adjusts the position of the first axis 24 and the location of the outer roller 14 relative to the tie bar 16.

The second end 22 of the inner pin 12 is spaced from the tie bar 16 and is enlarged to capture the outer roller 14 on the inner pin 12. The enlarged second end 22 of the inner pin 12 is preferably shaped as a cone with a conical outer surface 60. Alternatively, the enlarged end may have other shapes that function to retain the outer roller on the inner pin.

The enlarged conically shaped second end 22 of the inner pin fits within a matching conical recessed depression in the outer roller 14 so that the upper surface of the inner pin is substantially level with the upper surface of the outer roller.

The enlarged second end 22 of the inner pin 12 is also provided with a recessed crosshead opening 32 that receives a crosshead tool, such as a Phillips screwdriver. The tool is used to apply torque to the inner pin and rotate it about axis 30 to reposition the inner pin and axis 24 relative to the tie bar 16.

As indicated by phantom lines 34 in FIG. 3 the inner pin 12 is preferably permanently attached to the tie bar 16 by deforming and expanding the end of the mounting pin 26 where it extends through the tie bar 16. The deformation shown by phantom lines 34 produces a permanent rivet type connection. The connection is such that the inner pin can be rotated around axis 30 by applying torque with the crosshead tool, and the inner pin will then remain in the new position.

The length of the inner pin is such that the outer roller is trapped between the enlarged end 22 and the tie bar, but the outer roller 14 remains free to rotate about the inner pin.

FIG. 2 shows the inner pin rotated 90 degrees relative to the position seen in FIG. 1. As may be seen by comparing the position of the roller pin in FIG. 1 with the position in FIG. 2, the rotation of the inner pin adjusts the location of the entire roller pin relative to the tie bar 16 and the keeper 36.

Referring to FIG. 3, the outer roller 14 includes an outer bearing surface 38 and an outwardly extending perimetrical flange 40 at one end thereof. The flange preferably extends outward perpendicular outward from the outer bearing surface 38. Unlike prior art designs, the perimeter of flange 40 is circular and the flange rotates with the roller bearing instead of remaining stationary with the inner pin.

Referring to FIG. 2, the flange 40 is larger in diameter than the inner opening 48 of the keeper 36 and serves to retain the keeper 36 between the tie bar and the perimetrical flange 40. The keeper 36 is typically attached to the casement window sash. When the window is closed, the keeper moves in the direction indicated by arrow 44 into position in front of the roller pin. This positions the opening 48 in the keeper 36 in front of the roller pin 10. The tie bar 16 is connected to a conventional locking handle (not shown) which slides the tie bar in the direction indicated by arrow 50 towards the keeper 36 and into opening 48. Ramped surface 52 on the keeper 36 will pull the keeper 36 and the attached window sash into the correct position if the window has not been fully closed.

As previously described, the roller pin 10 may be adjusted relative to the tie bar and the keeper by rotating the inner pin relative to the tie bar. FIG. 2 shows a keeper 36 that has the center of the opening 48 misaligned relative to the centerline of the tie bar 16. By rotating the inner pin 90 degrees relative to the position in FIG. 1, the axis of rotation 24 of the outer roller has been brought into alignment with the opening 48.

The outer perimeter of the flange 40 is circular and has a diameter greater than the diameter of the opening 48 in the keeper 36. This traps the keeper 36 between a lower surface 54 of the flange 40 and the tie bar 16 when the keeper engages the roller pin. As the roller pin 10 moves into engaging contact with the keeper 36, the outer roller 14 and the flange 40 rotate together reducing friction with the keeper 36.

In the preferred design, the enlarged head 22 of the inner pin includes a conical outer surface 60 that engages a recessed and corresponding conical surface on the inside of the roller 14 to retain the outer roller between the enlarged end 22 of the inner pin 12 and the tie bar 16. The recessed opening in the outer roller allows the upper surface of the outer roller flange 40 to be substantially level with the end 22 of the inner pin 12. This provides an attractive appearance for the roller pin and reduces clearance requirements.

Although the preferred embodiment includes a crosshead recessed opening 32 for adjusting the position of the roller pin, alternative designs for applying adjustment torque may be used. The opening 32 is preferably recessed for a tool and may be a hex opening for an Allen wrench, a slotted opening for a conventional screwdriver, a Torx head, a square opening for a Robertson screwdriver and other known screw and bolt head designs. Alternatively, the inner pin may be provided with an outwardly extending bolt head or other shape that is gripped on the outer surface.

The connection of the mounting pin 26 to the tie bar 16 may also be accomplished through methods other than the illustrated deformation of the end of the mounting pin. Alternative known mounting methods may include threading the mounting pin 26 and attaching a nut to the end 20, using a circular clip, a friction clip or a split pin inserted perpendicular to the mounting pin.

Figure 4:
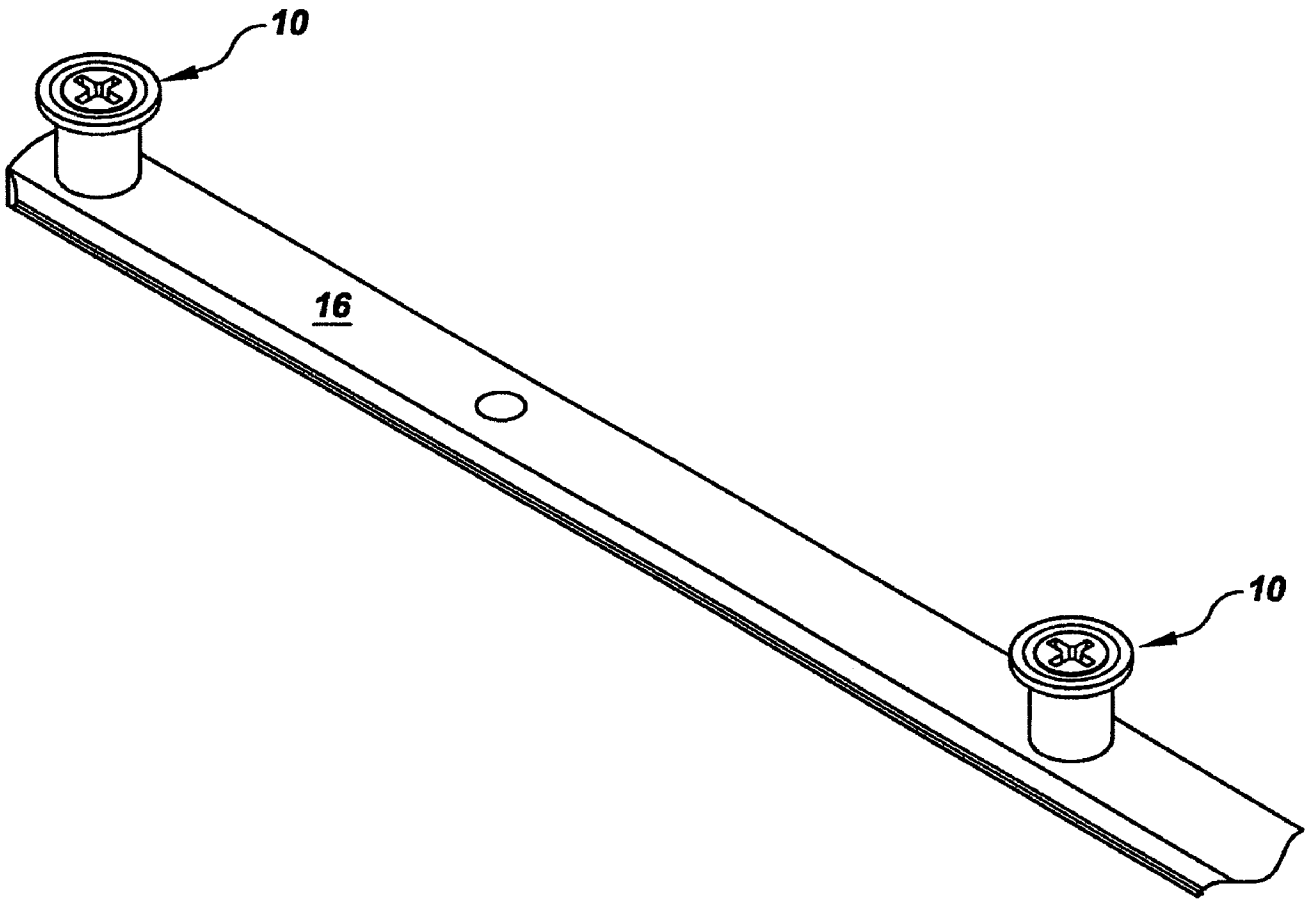
FIG. 4 is a perspective view showing one end of a tie bar having multiple roller pins according to the present invention mounted thereon.

Referring to FIG. 4, the invention also includes a tie bar 16 with multiple roller pins 10 installed in spaced opening 28 (see FIG. 3). The tie bar and the multiple pins slide to engage multiple corresponding keepers on the casement window.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A casement lock, comprising:

a sliding tie bar having a roller pin mounted on said tie bar, said roller pin for engagement with and disengagement from a keeper for placing the casement lock in a locked position and an unlocked position;

said roller pin including an inner pin having a middle portion, a first end and a second end wherein:

the middle portion of the inner pin is substantially cylindrical and defines a first axis of rotation;

the first end of the inner pin includes a mounting pin pivotally connected to tie bar, the mounting pin defining a second axis of rotation offset from the first axis of rotation, wherein the mounting pin is rotatable about the second axis; and the second end of the inner pin is enlarged relative to the middle portion and includes an upper surface defining a substantially circular outer perimeter and a recessed opening formed within said outer perimeter shaped to be engaged by a tool for rotating the inner pin around the second axis of rotation relative to the tie bar to reposition the middle portion of the inner pin relative to the tie bar, the recessed opening allowing the tool to engage the upper surface of the inner pin and rotate the inner pin around the second axis of rotation without engaging an exterior edge of the upper surface of the inner pin; and said roller pin including a substantially cylindrical outer roller mounted on the inner pin, wherein the outer roller is rotatable about the first axis of rotation, the outer roller having an outer bearing surface, and an outwardly extending perimetrical flange at one end thereof, the perimetrical flange having a substantially circular outer perimeter, the outer roller having an upper surface with a recessed depression formed therein, the recessed depression being shaped to receive the enlarged second end of the inner pin and position the upper surface of the second end of the inner pin at or below the upper surface of the outer roller, the outer roller being rotatably held between the enlarged second end of the inner pin and the tie bar, the perimetrical flange acting to retain the keeper between the tie bar and the perimetrical flange and the perimetrical flange rotating with the outer roller to reduce friction between the roller pin and the keeper during engagement.

2. The roller pin according to claim 1 wherein the recessed opening in the enlarged second end of the inner pin is shaped to receive a screwdriver.

3. The roller pin according to claim 1 wherein the recessed opening in the enlarged second end of the inner pin is a recessed crosshead opening shaped to receive a crosshead screwdriver.

4. The roller pin according to claim 1 wherein the second end of the inner pin includes a conical outer surface acting to retain the outer roller.

5. The roller pin according to claim 1 wherein the perimetrical flange includes an upper surface and a lower surface, the upper surface of the perimetrical flange corresponding to the upper surface of the outer roller and being substantially level with the upper surface of the second end of the inner pin and the lower surface of the perimetrical flange acting to retain the keeper between the tie bar and the perimetrical flange.

6. The roller pin according to claim 1 wherein the mounting pin extends through the tie bar.

7. The roller pin according to claim 1 wherein the mounting pin extends through the tie bar and is enlarged on an opposite side of the tie bar to rotatably retain the roller pin on the tie bar.

8. The roller pin according to claim 1 wherein the outwardly extending perimetrical flange and the outer bearing surface form a right angle and are integrally formed as a single piece with the outer roller.

9. A casement lock, comprising;

a sliding tie bar having a plurality of roller pins mounted on the tie bar, wherein at least one of said plurality of roller pins is for engagement with and disengagement from a keeper for placing the casement lock in a locked position and an unlocked position;

wherein the tie bar includes a plurality of spaced mounting holes corresponding to the plurality of roller pins; and wherein each of the plurality of roller pins comprises:

an inner pin having a middle portion, a first end and a second end wherein:

the middle portion of the inner pin is substantially cylindrical and defines a first axis of rotation;

the first end of the inner pin includes a mounting pin extending through a corresponding one of the mounting holes in the tie bar to pivotally connect the mounting pin to the tie bar, the mounting pin defining a second axis of rotation offset from the first axis of rotation, wherein the mounting pin is rotatable about the second axis; and the second end of the inner pin is enlarged relative to the middle portion and includes an upper surface defining a substantially circular outer perimeter and a recessed opening formed within said outer perimeter shaped to be engaged by a tool for rotating the inner pin around the second axis of rotation relative to the tie bar to reposition the middle portion of the inner pin relative to the tie bar, the recessed opening allowing the tool to engage the upper surface of the inner pin and rotate the inner pin around the second axis of rotation without engaging an exterior edge of the upper surface of the inner pin; and a substantially cylindrical outer roller mounted on the inner pin, wherein the outer roller is rotatable about the first axis of rotation, the outer roller having an outer bearing surface, an outwardly extending perimetrical flange at one end thereof, the perimetrical flange having a substantially circular outer perimeter, the outer roller having an upper surface with a recessed depression formed therein, the recessed depression being shaped to receive the enlarged second end of the inner pin and position the upper surface of the second end of the inner pin at or below the upper surface of the outer roller, the outer roller being rotatably held between the enlarged second end of the inner pin and the tie bar, the perimetrical flange acting to retain the keeper between the tie bar and the perimetrical flange and the perimetrical flange rotating with the outer roller to reduce friction between the roller pin and the keeper during engagement.

10. The plurality of roller pins and tie bar according to claim 9 wherein the recessed opening in the enlarged second end of each inner pin is shaped to receive a screwdriver.

11. The plurality of roller pins and tie bar according to claim 9 wherein the recessed opening in the enlarged second end of each inner pin is a recessed crosshead opening shaped to receive a crosshead screwdriver.

12. The plurality of roller pins and tie bar according to claim 9 wherein the second end of each inner pin includes a conical outer surface acting to retain the outer roller.

13. The plurality of roller pins and tie bar according to claim 9 wherein the perimetrical flange of each roller pin includes an upper surface and a lower surface, the upper surface of the perimetrical flange corresponding to the upper surface of the outer roller and being substantially level with the upper surface of the second end of the inner pin, the lower surface of the perimetrical flange acting to retain the keeper between the tie bar and the perimetrical flange.

14. The plurality of roller pins and tie bar according to claim 9 wherein each mounting pin extends through the tie bar.

15. The plurality of roller pins and tie bar according to claim 9 wherein each mounting pin extends through the tie bar and is enlarged on an opposite side of the tie bar to rotatably retain the roller pin on the tie bar.

16. The plurality of roller pins and tie bar according to claim 9 wherein the outwardly extending perimetrical flange and the outer bearing surface of each roller pin form a right angle and are integrally formed as a single piece with the outer roller.

17. A casement lock, comprising:

a sliding tie bar having a roller pin mounted on the tie bar, the tie bar and roller pin both being movable for engagement and disengagement from with a keeper for placing the casement lock in a locked position and an unlocked position;

the keeper having a hook and a ramped surface for engagement with the roller pin;

the roller pin including an inner pin and an outer roller mounted thereon;

the inner pin including a first end, a second end and a substantially cylindrical middle portion defining a first axis of rotation;

the first end of the inner pin including a mounting pin pivotally connected to the tie bar, the mounting pin defining a second axis of rotation offset from the first axis of rotation, wherein the mounting pin is rotatable about the second axis; and the inner pin is enlarged at the second end, the second end includes a substantially flat upper surface having a recessed opening formed therein and is shaped to be engaged within the recessed opening of the upper surface by a tool for rotating the inner pin around the second axis of rotation relative to the tie bar to reposition the inner pin relative to the tie bar without engaging an exterior edge of the upper surface of the inner pin; and the outer roller is substantially cylindrical, and includes an outwardly extending perimetrical flange at one end thereof, the perimetrical flange defining a substantially circular outer perimeter, the outer roller having an upper surface with a recessed depression formed therein to receive the enlarged second end of the inner pin, the upper surface of the inner pin being substantially level with the upper surface of the outer roller and the outer roller being mounted on the inner pin, wherein the outer roller is rotatable about the first axis of rotation.

* * * * *